US006412839B1

(12) United States Patent
Tran

(10) Patent No.: US 6,412,839 B1
(45) Date of Patent: Jul. 2, 2002

(54) TENNIS BALL RETRIEVER AND STORAGE UNIT

(76) Inventor: William V. Tran, 9509 Dawnshire Rd., Raleigh, NC (US) 27615

( * ) Notice: Subject to any disclaimer, the term of this patent is extended or adjusted under 35 U.S.C. 154(b) by 0 days.

(21) Appl. No.: 09/909,082

(22) Filed: Jul. 20, 2001

(51) Int. Cl.[7] ..... A63B 47/02
(52) U.S. Cl. ..... 294/19.2; 16/44; 280/47.34
(58) Field of Search ..... 294/192; 16/44; 56/328.1; 206/315.9; 224/919; 280/47.17, 47.24, 47.34, 47.35, 47.41; 414/437, 440

(56) References Cited

U.S. PATENT DOCUMENTS 2,042,525 A * 6/1936 Herold ..... 16/44
3,349,425 A * 10/1967 Rabelos ..... 16/44
3,371,950 A * 3/1968 Stap ..... 294/19.2 X
4,461,504 A * 7/1984 Perez et al. ..... 294/19.2
5,464,262 A * 11/1995 Madrazo ..... 294/19.2
5,507,541 A * 4/1996 Chen et al. ..... 294/19.2
5,875,519 A * 3/1999 Chou ..... 16/44 X
6,142,544 A * 11/2000 Benzoni et al. ..... 294/19.2

* cited by examiner

*Primary Examiner*—Johnny D. Cherry
(74) *Attorney, Agent, or Firm*—Mills Law Firm PLLC

(57) ABSTRACT

A tennis ball retriever and storage unit includes a ball retrieving receptacle supported by spring biased pivoting wheel assemblies for rolling movement between locations for retrieving used tennis balls and downwardly movement from a normal upper transport position overlying a tennis ball to a lower position for retrieving the tennis ball between spaced bars in the base of the receptacle.

9 Claims, 3 Drawing Sheets

FIG. 2
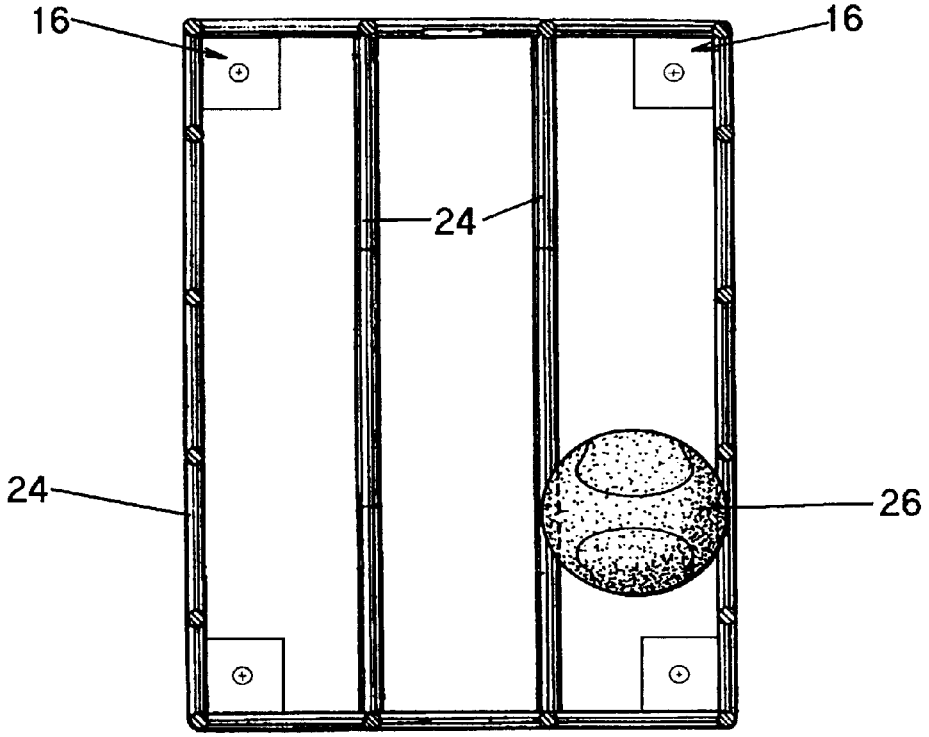
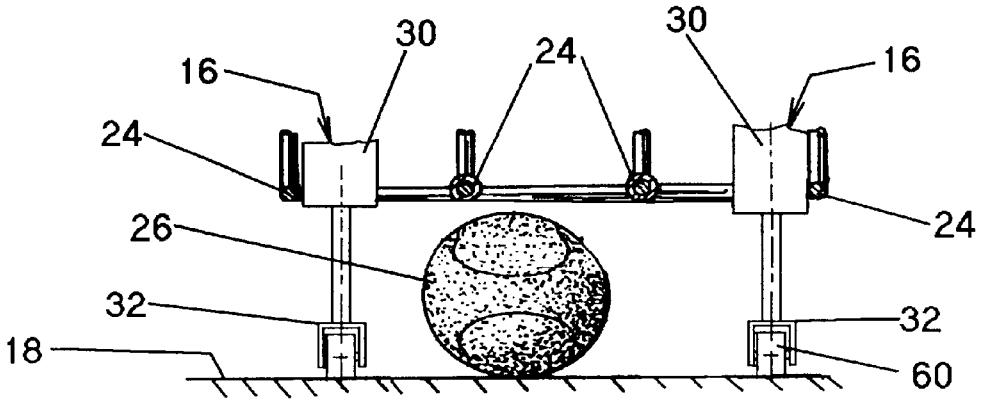
FIG. 3
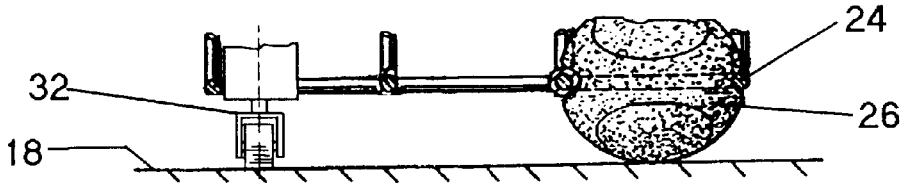
FIG. 4

TENNIS BALL RETRIEVER AND STORAGE UNIT

FIELD OF THE INVENTION

The present invention relates to devices for retrieving tennis balls, and, in particular, a tennis ball retriever and storage cart having a spring assisted retrieval capability and roller supported travel capability.

BACKGROUND OF THE INVENTION

During practice for sporting activities such as golf and tennis, a large number of balls are hit in an effort to improve skill levels. Periodically, the balls must be retrieved and various designs have been used to simplify the retrieval, as wells as providing a storage receptacle for the balls. Typical conventional retrieval and storage units are disclosed in U.S. Pat. No. 3,371,950 to Stap, U.S. Pat. No. 3,820,836 to Seewagen et al. and U.S. Pat. No. 4,811,980 to Ferrari et al.

The units comprise a rectangular receptacle comprised of spaced small diameter wires forming an enclosure cage for the balls. To aid in the retrieval of the ball, the base of the cage includes a plurality of laterally spaced base bars. Adjacent base bars are spaced a distance slightly less than the diameter of the standard tennis ball. Individual balls are retrieved by lifting the cage over the ball with the base bars straddling opposite sides of the ball. As the cage is lowered, the ball is locally compressed. As the ball passes over center, the resilient compression of the ball reestablishes the spherical shape forcing the ball upwardly into the storage receptacle, commingled with other retrieved balls.

While readily and conveniently useable for retrieving, the units must be physically lifted and carried to the site of each ball. Considerable distances are traversed in reaching the generally randomly distributed retrieval locations, and as the receptacle fills it becomes heavy and increasingly laborious to lift and move. In an effort to ease the effort in horizontally transporting the units, fixed support wheels have been proposed as disclosed in U.S. Pat. No. 4,461,504 to Perez et al. The wheels ease the transporting of the unit between ball locations, however, at each ball site, the cage must be physically raised and positioned over the ball.

SUMMARY OF THE INVENTION

The present invention retains the simplicity and each of operation of the prior retrieval and storage units while providing a rolling unit that may be readily transported on wheels between ball locations, positioned appropriately over the target ball without requiring lifting, and manually lowered against resilient resistance to capture automatically the balls within the receptacle. The foregoing features are accomplished by supporting the cage on spring biased swivel wheels that normally space the base above the height of the ball, allowing the receptacle to be rolled into a location wherein the capturing base bars are appropriately disposed for capture. To retrieve the target ball, the operator downwardly depresses the cage against the resistance of the spring suspension to pick up the ball in a conventional manner.

Accordingly, it is an object of the present invention to provide a retrieval unit for sporting balls that may be transported to select locations without lifting.

A further object of the invention is to provide a tennis ball retrieval and storage unit that is moved without lifting between locations and shifted downwardly from a normal support position to retrieve the ball.

Another object of the invention is to provide a tennis ball retrieval unit having swivel wheels that allow transporting without lifting between locations, and a spring suspension that is manually depressed to effect capture and loading of the ball.

DESCRIPTION OF THE DRAWINGS

The above and other objects and advantages of the present invention will become apparent upon reading the following detailed description taken in conjunction with the accompanying drawings in which:

FIG. 2 is a top horizontally sectioned view of the tennis ball retrieval and storage unit illustratively showing a tennis ball retained therewithin;

FIG. 3 is a fragmentary front view of the tennis ball retrieval and storage unit in the normal transport position positioned above a tennis ball prior to retrieval;

FIG. 4 is a view similar to FIG. 3 showing the capture position of the tennis ball.

DETAILED DESCRIPTION OF THE PREFERRED EMBODIMENTS

Figure 1:
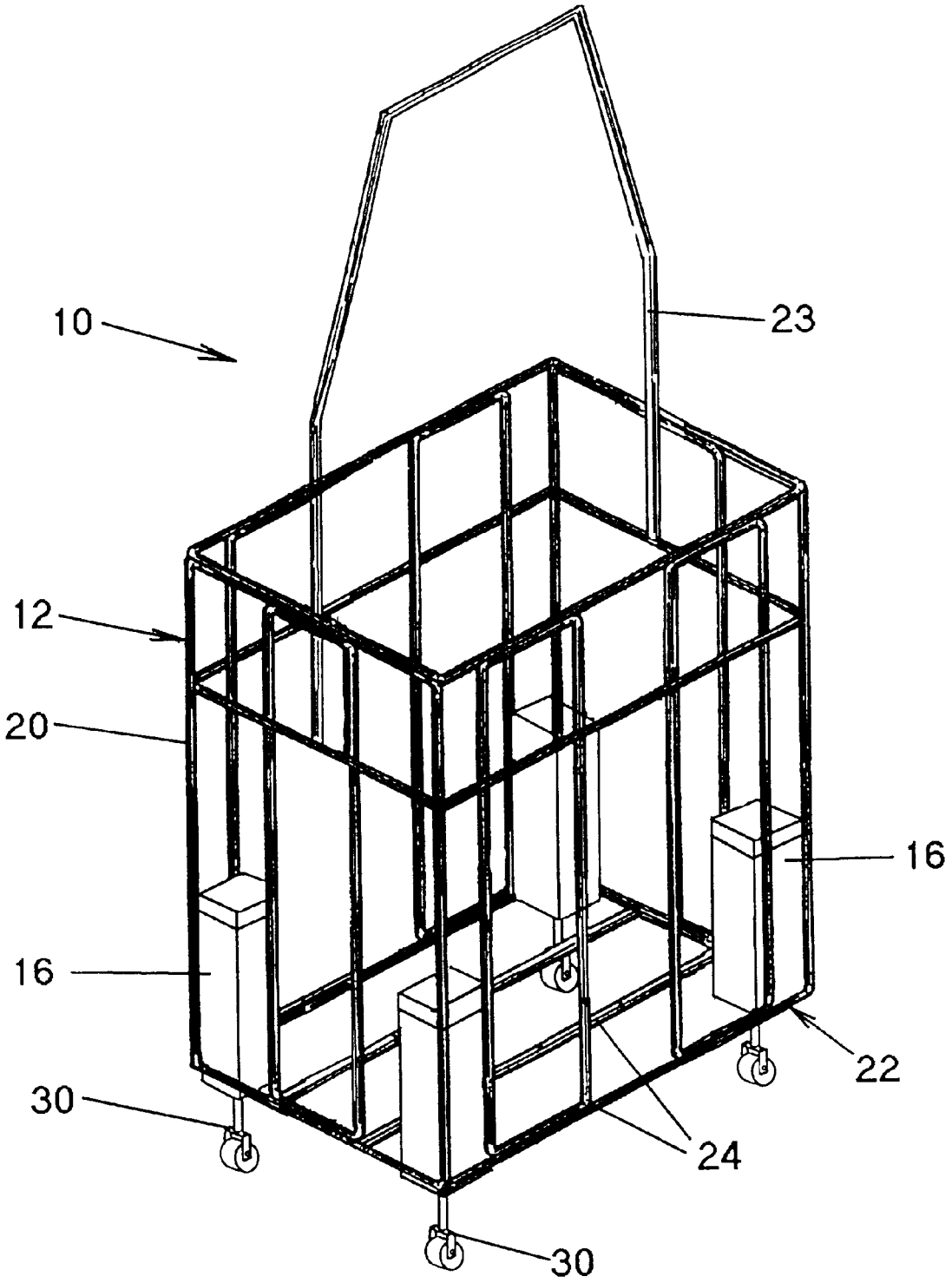
FIG. 1 is a perspective view of the tennis ball retrieval and storage unit in accordance with a preferred embodiment of the invention.

Referring to the drawings for the purpose of describing the preferred embodiment and not for limiting same, FIG. 1 illustrates a tennis ball retriever and storage unit 10 having a generally cubical open frame receptacle 12 supported for rolling and vertically reciprocating movement on a playing surface 18 by wheel assemblies 16 carried on the perimeter at the outer lower comers of the receptacle 12 and located interior of the receptacle.

The receptacle 12 may take various forms as commercially available and commonly called "ball hoppers". Generally, the receptacle 12 includes othogonally disposed vertical side walls 20 and a horizontal base 22. A handle 23 is attached at lower ends to opposed side walls 20 for lifting and transporting. A top cover may be provided for the receptacle, if desired. The side walls 20 are comprised of interlaced wire rods or wires to form an open grid. Solid, perforated or mesh constructions may also be used, with openings smaller than the tennis balls to thereby provide secure retention for storage. As shown additionally in FIGS. 2 through 4, the base 22 includes a plurality of longitudinally extending, laterally spaced bars 24. The lateral spacing between the bars 24 is less than the diameter of the standard tennis ball, i.e. less than about 2⅝ inches. Preferably, the spacing between the bars is about 2 to 2⅜ inches. In a well known manner and as illustrated in FIGS. 3 and 4, for retrieving a tennis ball, the base 22 is located vertically over the tennis ball 26 with the bars 24 roughly straddling the ball 26. As the unit 10 is moved downwardly, the ball 26 is locally elastically compressed. When downward movement is continued beyond the center position shown in FIG. 4, the elastic forces reestablish the ball contours and squeeze the ball upwardly into the receptacle for commingling with other tennis balls contained therein.

Conventionally, the receptacle is manually transported between ball locations. The wheel assemblies 16 permit the unit 10 to be rolled between ball locations, and manually depressed to retrieve the tennis ball 26 into the receptacle 12, and released for return to the normal transport position shown in FIG. 3.

Figure 5:
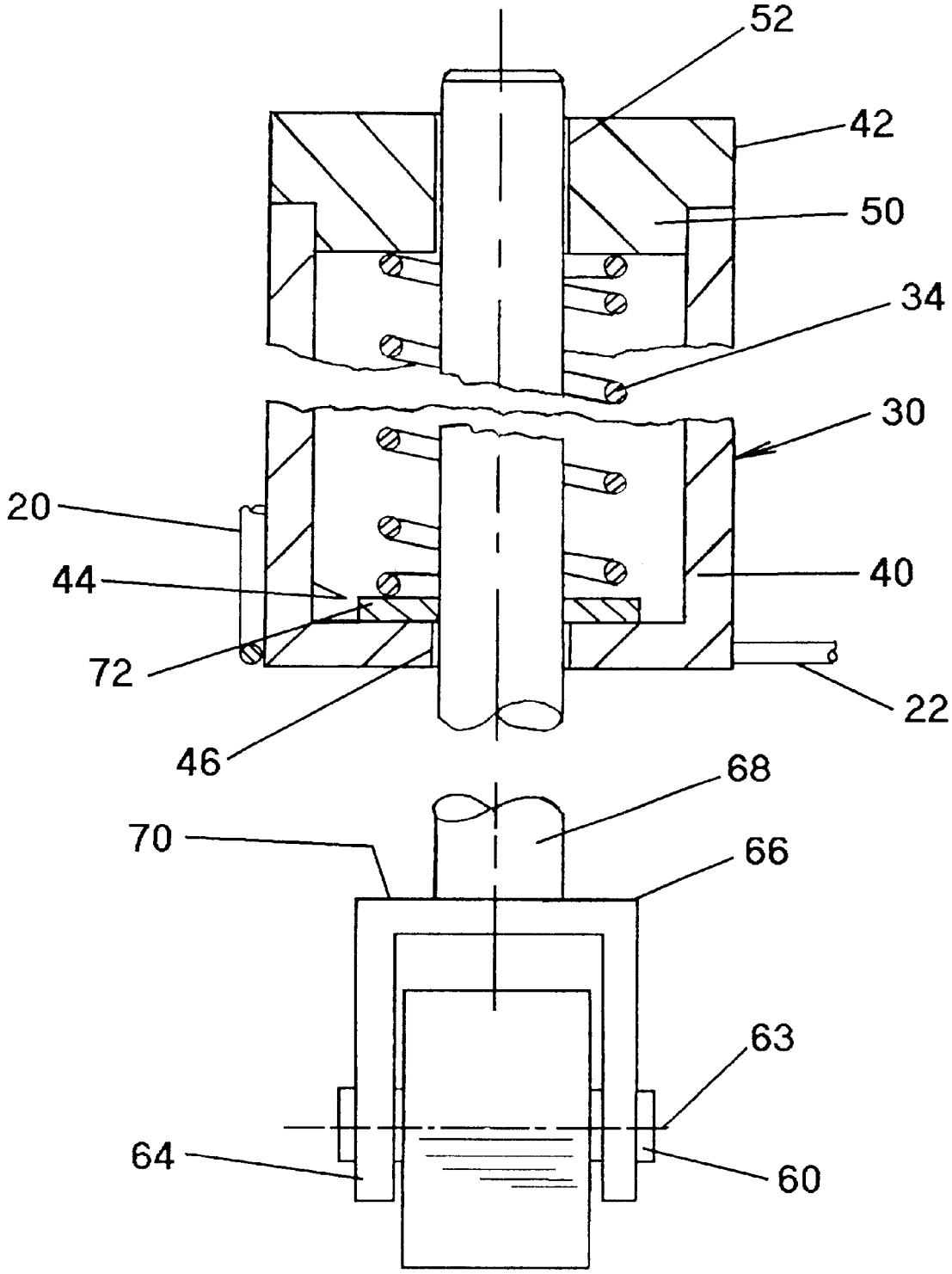
FIG. 5 is an enlarged fragmentary cross sectional view of a spring biased wheel assembly on the tennis ball retrieval and storage unit in the normal transport position.

Each wheel assembly 16 is attached by suitable means to the side walls 20 and base 22 at the lower corners thereof. The wheel assembly 16 as shown in FIG. 5 includes a housing 30, and a swivel wheel 32 biased to a normal transport position as shown in FIG. 3 by an internal compression spring 34.

The housing 30 includes a base section 40 and a top section 42. The base section 40 includes an upwardly opening bore 44 and a vertical through-hole 46 between the lower surface of the base section and the bore 44. The top section 42 includes an annular sleeve 50 telescopically received in the bore 44 and a through-hole 52 coaxially aligned with the hole 46 in the base section 40. The top section 42 is fixedly connected to the base section 40 by compression fit or other suitable fastening means.

The wheel 32 includes a cylindrical roller 60 carried on a horizontal shaft 62 for rotation about a horizontal axis 63. The ends of the shaft 62 are attached to downwardly extending legs 64 on an inverted U-shaped bracket 66. An upwardly extending cylindrical shaft 68 is attached to the horizontal base 70 of the bracket 66. The shaft 68 is pivotally and slidably supported at the cylindrical surfaces of the holes 46 and 52. An annular ring or washer 72 is fixed to the shaft 68 and engages the base of the bore 44 to establish the normal transport position. It will be apparent that varying wheel constructions may be employed for providing the swiveling and rolling movement required. Moreover, the housing may be recessed at the base for providing additional downward movement of the unit.

The compression spring 34 is compressively loaded between the base of the bore 44 and the sleeve 50. The preload compression is sufficient to maintain the normal transport position supporting the weight of the receptacle, a full quota of stored tennis balls, and design allowances. The housing 30 and the spring 34 accommodate sufficient downward movement enabling the lower surface of the base section 40 to engage the bracket 66 and effect a lower retrieval position against the biasing of the spring 34 to capture the tennis ball in the established well known manner.

In use, the unit 10 may be used as a storage device for the tennis balls at a desired location and transferred thereto without requiring manual lifting, or manually carried at the handle 23. During a practice session, the receptacle may be used for directly accessing the tennis balls or the same may be transferred therefrom to a practice device or supplemental carrier. When it is desired to retrieve the tennis balls, the unit 10 may be rolled on the playing surface 18, without lifting, to a location overlying the tennis ball, the receptacle 12 depressed from the normal transport position to the capture position, and thereafter automatically returned by the spring 34 for subsequent movement to another location.

Having thus described a presently preferred embodiment of the present invention, it will now be appreciated that the objects of the invention have been fully achieved, and it will be understood by those skilled in the art that many changes in construction and widely differing embodiments and applications of the invention will suggest themselves without departing from the sprit and scope of the present invention. The disclosures and description herein are intended to be illustrative and are not in any sense limiting of the invention, which is defined solely in accordance with the following claims.

What is claimed:

1. A tennis ball retriever and storage unit comprising: an upright receptacle having side walls and a horizontal base defining a container volume for containing and storing a quantity of tennis balls, said base including a plurality of spaced bars, the spacing between said bars being less than the diameter of a tennis ball such that a ball may be squeezed between the bars to gain entry into said container volume by vertical downward movement from an upper position; a plurality of wheel assemblies mounted at the perimeter of said receptacle, each of said wheel assemblies including a pivotal and reciprocable roller engagable with a base surface from which a tennis ball is to be received; spring means operatively associated with said roller for normally biasing said receptacle to said upper position.

2. The tennis ball retriever and storage unit as recited in claim 1 wherein said spring means is sufficient to maintain said upper position in the presence of said quantity of balls carried in said receptacle.

3. The tennis ball retriever and storage unit as recited in claim 2 wherein said bars are elongated, relatively inflexible rods and uniformly spaced on said base.

4. The tennis ball retriever and storage unit as recited in claim 3 wherein said receptacle is generally rectangular.

5. The tennis ball retriever and storage unit as recited in claim 4 wherein said wheel assemblies are carried adjacent the outer corners of said base.

6. The tennis ball retriever and storage unit as recited in claim 5 wherein said wheel assemblies are carried inwardly of said side walls.

7. The tennis ball retriever and storage unit a recited in claim 5 wherein said spring means is a helically coiled compression spring.

8. The tennis ball retriever and storage unit as recited in claim 7 wherein each said wheel assembly includes a housing member attached to said side walls having an interior cavity terminating with vertically aligned apertures, and said roller includes a vertical shaft slidably and pivotally supported at said apertures, and said spring means is carried in said cavity and cooperates between said shaft and said housing member for effecting said upper position.

9. The tennis ball retriever and storage unit as recited in claim 8 wherein said roller is cylindrical.

* * * * *